US007546825B2

(12) United States Patent
Keeton et al.

(10) Patent No.: US 7,546,825 B2
(45) Date of Patent: Jun. 16, 2009

(54) MULTI-CHAMBERED FUEL ENRICHMENT DEVICE

(75) Inventors: William B. Keeton, Texarkana, TX (US); Rodney W. Tynes, Shreveport, LA (US)

(73) Assignee: Husqvarna Outdoor Products Inc., Augusta, GA (US)

( * ) Notice: Subject to any disclaimer, the term of this patent is extended or adjusted under 35 U.S.C. 154(b) by 94 days.

(21) Appl. No.: 11/567,415

(22) Filed: Dec. 6, 2006

(65) Prior Publication Data

US 2008/0135018 A1 Jun. 12, 2008

(51) Int. Cl.
*F02N 17/00* (2006.01)

(52) U.S. Cl. ..... 123/179.9

(58) Field of Classification Search ..... 123/179.7, 123/179.9, 179.12, 179.15, 527
See application file for complete search history.

(56) References Cited

U.S. PATENT DOCUMENTS 2,287,900 A * 6/1942 Parker ..... 123/179.12
3,587,553 A * 6/1971 Sutton ..... 123/179.13
3,693,947 A * 9/1972 Masaki et al. ..... 261/39.3
3,780,996 A 12/1973 Nutten
3,872,851 A * 3/1975 Matsumoto et al. .... 123/179.15
3,886,920 A * 6/1975 Van Dusen et al. ..... 123/519
3,888,223 A * 6/1975 Mondt ..... 123/519
4,285,308 A * 8/1981 Hundertmark et al. ... 123/179.9
4,508,068 A 4/1985 Tuggle et al.
4,735,751 A 4/1988 Guntly
4,787,356 A * 11/1988 Rosgen et al. ..... 123/438
4,814,114 A * 3/1989 Charmley ..... 261/35
4,848,290 A * 7/1989 Miller ..... 123/179.13
4,905,641 A * 3/1990 Miller ..... 123/179.13
5,052,359 A * 10/1991 Hardwick et al. ..... 123/406.45
5,094,784 A 3/1992 Ditter
5,240,649 A * 8/1993 Yamada et al. ..... 261/34.2
5,372,101 A * 12/1994 Hoshiba et al. ..... 123/179.15
5,803,035 A 9/1998 Guntly
5,891,369 A 4/1999 Tuggle et al.
6,079,697 A 6/2000 Tuggle et al.
6,135,429 A * 10/2000 Woody ..... 261/35
6,152,431 A 11/2000 Stenz et al.
6,557,833 B1 5/2003 Roth

OTHER PUBLICATIONS

International Search Report (PCT/US07/86624) dated Aug. 25, 2008.

* cited by examiner

*Primary Examiner*—Stephen K Cronin
*Assistant Examiner*—Arnold Castro
(74) *Attorney, Agent, or Firm*—Pearne & Gordon LLP

(57) ABSTRACT

A fuel enrichment device includes a body forming a first fuel chamber and a second fuel chamber. The second fuel chamber is adapted to contain a predetermined amount of enriching fuel to be provided to an engine. A normally open valve connects the first fuel chamber to the second fuel chamber. A normally closed valve for controls the provision of enriching fuel to the engine. The normally closed valve is open whenever the normally open valve is closed.

22 Claims, 3 Drawing Sheets

MULTI-CHAMBERED FUEL ENRICHMENT DEVICE

BACKGROUND OF THE INVENTION

1. Field of the Invention

The present invention relates to a fuel delivery system for an internal combustion engine, and more particularly to a fuel enrichment device having multiple chambers.

2. Description of Related Art

A hand-held power device such as a chainsaw, hedge trimmer, line trimmer or edger is often powered by small internal combustion engine outfitted with a diaphragm carburetors. Generally, a diaphragm carburetor has an air passage with a venturi, a diaphragm pump, a needle valve and a metering chamber containing a spring-biased diaphragm. The outlet of the air passage leads to an intake tract or crankcase of the engine. A throttle valve of the butterfly type is typically mounted in the air passage to control the amount of fuel and air entering the intake tract or crankcase.

Fuel is drawn into the carburetor by the diaphragm pump, which is connected to the metering chamber through the needle valve. The metering chamber, in turn, is connected to the air passage through supply passages fitted with one-way valves. The supply passages open to the air passage through a plurality of outlet ports. The opening and closing of the needle valve and, thus, the flow of fuel into the metering chamber is controlled by a spring-biased diaphragm, which is mounted inside the metering chamber.

During normal operation of the engine, pulses of pressure from the engine cause the diaphragm pump to pump fuel from a storage tank up to the needle valve. Subatmospheric air pulses passing through the venturi create a negative pressure in the metering chamber, causing a displacement of the metering chamber diaphragm. The displacement of the diaphragm opens the needle valve and permits fuel to enter the metering chamber. The fuel exits the metering chamber through the outlet ports and enters the air passage where it is atomized. Eventually, the flow of fuel into the metering chamber increases the pressure in the metering chamber, causing the diaphragm to close the needle valve and stop the flow of fuel. As the fuel empties from the metering chamber, the pressure in the metering chamber drops until the diaphragm is again displaced and the needle valve opens. In this manner, the diaphragm in the metering chamber continually opens and closes the needle valve, thereby introducing metered amounts of fuel into the air passage.

Since the delivery of fuel in a diaphragm carburetor is not dependent upon gravity, the operation of a diaphragm carburetor is not affected by its orientation. Accordingly, diaphragm carburetors are ideally suited for use in power devices such as chainsaws that may be held by an operator in a variety of positions. Engines utilizing diaphragm carburetors, however, tend to be difficult to start after a period of non-use because of an initial absence of fuel in the metering chamber and the diaphragm pump. Air choke mechanisms are utilized to remedy this situation. However, most air choke mechanisms are unable to quickly and efficiently establish a proper air to fuel ratio and can flood the engine by introducing excess fuel into the engine.

Air choke mechanisms are usually comprised of slide valves or butterfly valves. Typically, a butterfly valve will be rotatably mounted inside the air passage near the inlet. The butterfly valve often has a small orifice passing therethrough. Usually, the butterfly valve can be rotated between three different positions: an open position, a half-choke position and a full choke position. When the butterfly valve is in the open position, the inlet to the air passage is substantially open. In the half-choke position, the butterfly valve is partially closed and, thus, partially blocks the inlet to the air passage. In the full-choke position, the butterfly valve is closed and blocks the inlet to the air passage except for the small orifice. When the engine is cranked during starting, by a pull rope or otherwise, air is drawn out of the air passage and into the engine. If the choke mechanism is in a full-choke position or a half-choke position, the withdrawal of air creates a negative pressure condition in the air passage. Of course, the amount of pressure reduction is greater in the full-choke position than in the half-choke position. The negative pressure in the air passage creates a negative pressure in the metering chamber which displaces the diaphragm and allows fuel to enter the metering chamber and thence the air passage, where it mixes with air to create an air/fuel mixture.

During the initial cranking cycle, the choke mechanism is placed in a full-choke position to create a maximum vacuum in the air passage. In addition, the throttle valve is fully opened to permit the maximum vacuum to be applied to the outlet ports so as to create a maximum fuel draw. The opening of the throttle valve also permits a maximum amount of the air/fuel mixture to reach the intake tract or crankcase of the engine. In the full-choke position, however, the air/fuel mixture is very fuel-rich since only a small quantity of air can enter the air passage through the choke mechanism. As the engine begins to fire, more air is required to provide an adequate air/fuel ratio to keep the engine running. Accordingly, the choke mechanism must be moved to the half-choke position as soon as the first internal explosion, or "pop" occurs in the engine. If the choke mechanism is left in the full-choke position for too many cranking cycles after the "pop" occurs, the engine will become flooded with fuel and will not start. The engine will have to be allowed to rest long enough to permit the excess fuel in the crankcase and/or the combustion chamber to evaporate and a proper fuel-air mixture to be restored.

In the half-choke position, the choke mechanism increases the air content in the air/fuel mixture, but still provides a rich-running condition required by the engine during warm-up. After the engine has been running for a few seconds, the choke mechanism must be moved from the half-choke position to the open position to provide a correct air/fuel ratio.

In addition to an air choke, the engine's air/fuel delivery system can include a manually operated fuel enrichment device or primer that forces extra fuel into the carburetor's air passage during starting and during warm-up. The extra fuel results in an enriched air/fuel mixture.

Operation of the choke and primer systems discussed above require a skilled operator. An unskilled operator improperly applying the choke or primer could accidentally flood the engine. A priming system for enriching the air/fuel mixture automatically without requiring any positive action by the operator would be desirable.

BRIEF SUMMARY OF THE INVENTION

In accordance with one aspect of the invention, provided is a fuel enrichment device comprising a body forming a first fuel chamber and a second fuel chamber. The second fuel chamber is adapted to contain a predetermined amount of enriching fuel to be provided to an engine. A normally open valve connects the first fuel chamber to the second fuel chamber. A normally closed valve for controls the provision of enriching fuel to the engine. The normally closed valve is open whenever the normally open valve is closed.

In accordance with another aspect of the invention, provided is an engine priming system comprising an engine having an intake for receiving a fuel and air mixture and a carburetor having an air passage for mixing fuel and air. The air passage is in fluid communication with the intake. The system includes an automatic fuel enrichment device comprising a body forming a first fuel chamber in fluid communication with the carburetor and a second fuel chamber in fluid communication with both of the intake and the first fuel chamber. The automatic fuel enrichment device automatically provides a predetermined amount of enriching fuel directly to the intake.

In accordance with another aspect of the invention, provided a fuel enrichment device comprising a body forming a first fuel chamber and a second fuel chamber. The second fuel chamber is adapted to contain a predetermined amount of enriching fuel to be provided to an engine. A valve connects the first fuel chamber to the second fuel chamber. The valve is closed if the engine is running and open if the engine is not running. An additional valve controls the provision of enriching fuel to the engine. The additional valve is open if the engine is running and closed if the engine is not running

DESCRIPTION OF AN EXAMPLE EMBODIMENT OF THE INVENTION

Figure 1:
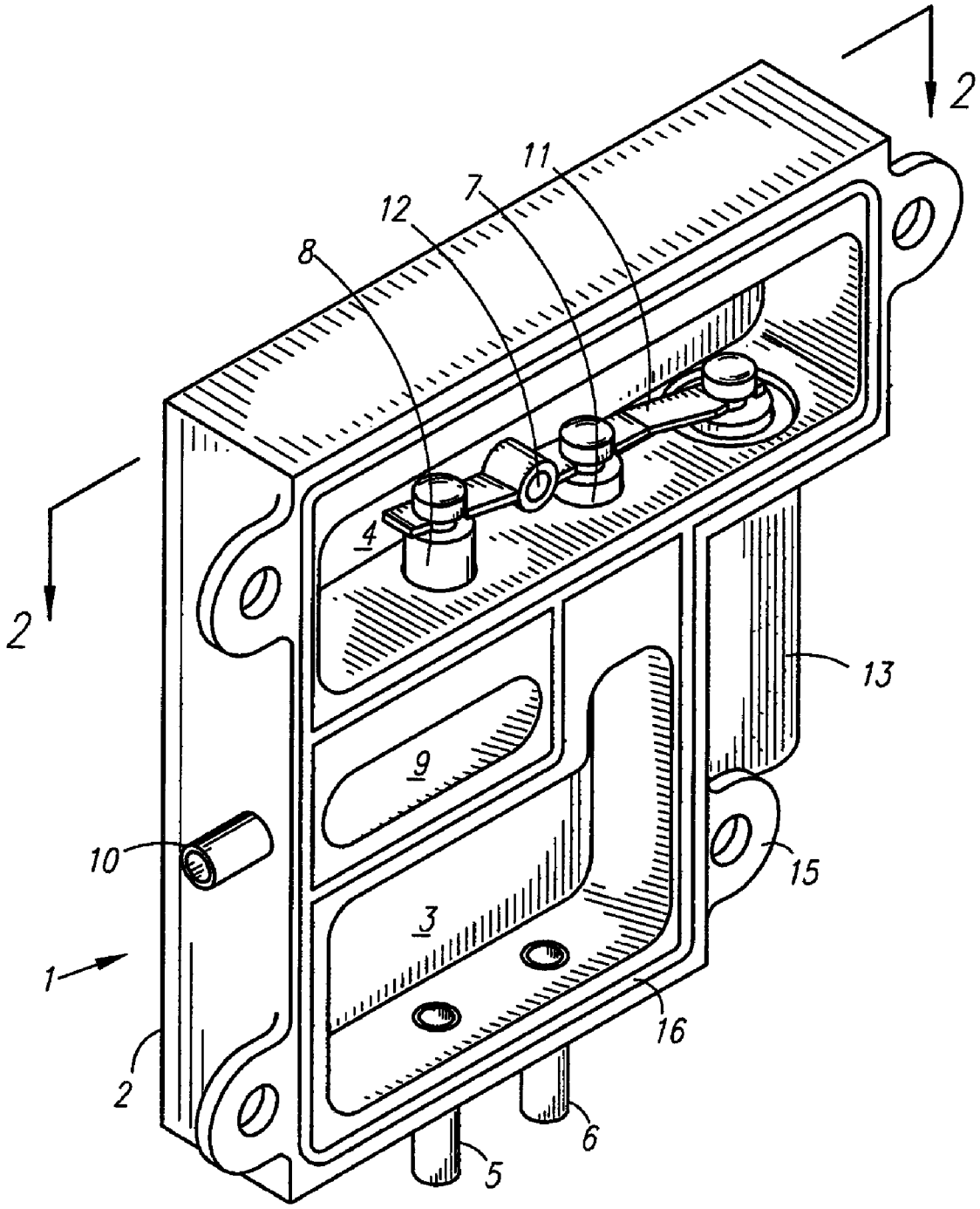
FIG. 1 is a perspective view of a multi-chambered fuel enrichment device.
Figure 2:
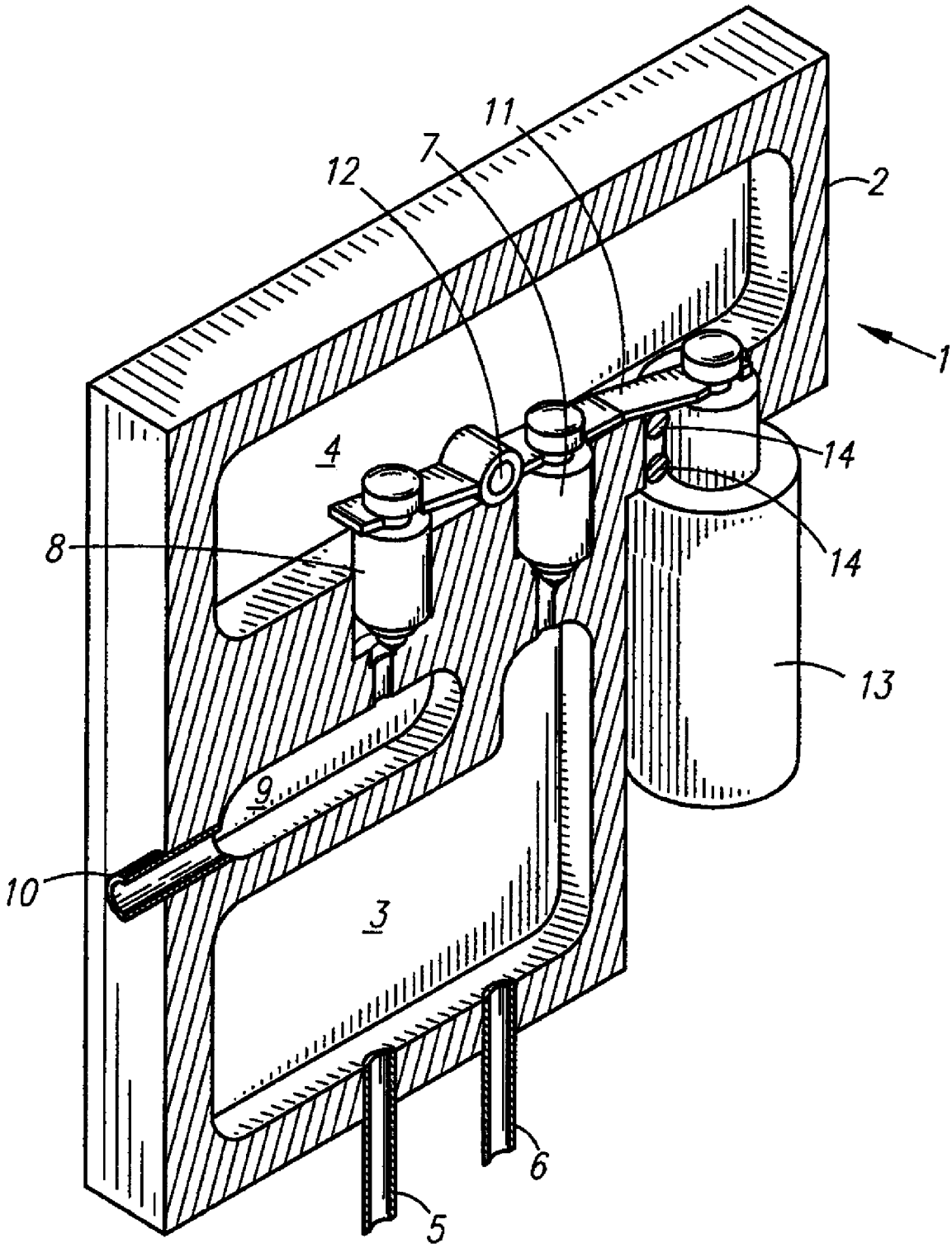
FIG. 2 is a partial section view of the device shown in FIG. 1.

Referring now to the drawings, which are for purposes of illustrating an example of the invention, FIGS. 1 and 2 show a perspective view of an example fuel enrichment device 1 or priming device, which forms a part of a fuel delivery system for an internal combustion engine. The fuel enrichment device 1 includes a body 2. The body 2 is designed to contain fuel. Suitable materials of construction for the body 2 include metals and polymers, such as plastics, for example.

The body 2 forms a first fuel chamber 3 and a second fuel chamber 4. The first fuel chamber 3 is in fluid communication with a fuel tank and carburetor, as can be seen schematically in FIG. 3. The first fuel chamber 3 receives fuel from the fuel tank 34 and provides fuel to the carburetor 33. An intake coupling 5 (FIG. 1) provides a point of connection for a fuel line that extends from the fuel tank, while a discharge coupling 6 provides a point of connection for a fuel line that extends to the carburetor.

The first fuel chamber 3 is in fluid communication with the second fuel chamber 4 through a normally open valve 7, for example a normally open needle valve. The normally open valve 7 is shown in the closed position in FIGS. 1 and 2, and in the open position in FIG. 3. The terms "normally open valve" refer to a valve that is biased in the open position at rest, and which requires an input of energy in order to move it to the closed position. The second fuel chamber 4 is in fluid communication with the engine's intake tract through a normally closed valve 8, for example a normally closed needle valve, and a discharge passageway 9. The normally closed valve 8 is shown in the open position in FIGS. 1 and 2, and in the closed position in FIG. 3. The terms "normally closed valve" refer to a valve that is biased in the closed position at rest, and which requires an input of energy in order to move it to the open position. A discharge coupling 10 provides a point of connection for a fuel line that extends to the engine's intake tract. In one embodiment, the second fuel chamber 4 discharges fuel directly to the engine's intake tract without an associated fuel line.

A beam 11 mounted on a pivot 12 connects the normally open valve 7 and the normally closed valve 8. The beam 11 mechanically interlocks the operation of the normally open valve 7 and normally closed valve 8, so that the normally closed valve 8 is open whenever the normally open valve 7 is closed. The mechanically interlocked valves are actuated by a single solenoid 13 that causes the beam 11 to swivel around the pivot 12. In FIGS. 1 and 2, the solenoid 13 is shown in the activated or powered position in which it holds the normally open valve 7 closed and the normally closed valve 8 open via the beam 11. The solenoid's 13 actuator projects into the second fuel chamber 4 and connect to the beam 11. O-rings 14 provide a sealed fitting between the solenoid 13 and second fuel chamber 4.

It is to be appreciated that the normally open valve 7 and normally closed valve 8 could be individually operated by separate solenoids, and that separate solenoids could be electrically interlocked.

In an embodiment, the fuel enrichment device 1 includes a cover (not shown) that can be secured to the device's body 2 through holes in flanged adapters 15. A gasket 16 provides a seal between the cover and body 2. The body 2 can be mounted to any suitable mounting location at the engine-driven device, such as to a housing, directly to the engine, or to the carburetor.

Figure 3:
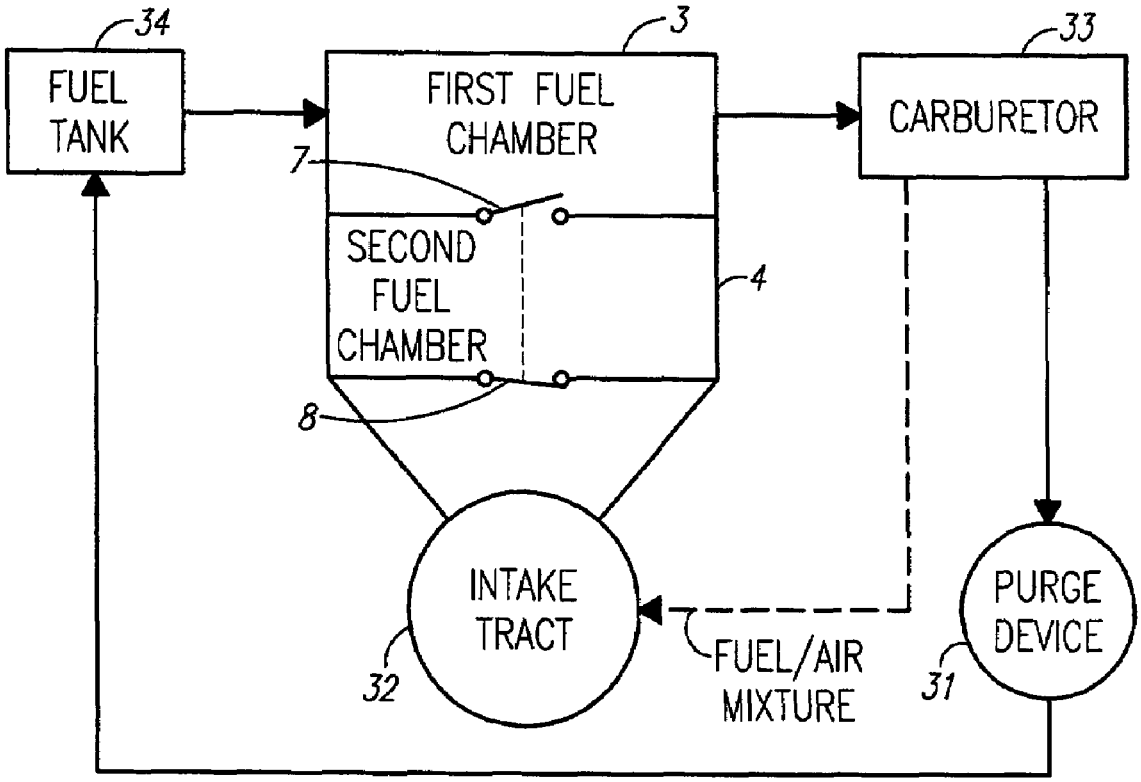
FIG. 3 is a schematic representation of a fuel delivery system that includes the multi-chambered fuel enrichment device.

Operation of the example fuel enrichment device will now be described. FIG. 3 schematically shows a fuel delivery system that includes the fuel enrichment device 1.

The fuel delivery system includes a purge device 31 (FIG. 3), for example a manually operated resilient purge bulb. Operation of the purge device, for example pumping the purge bulb, removes air from the fuel delivery system and fills the first fuel chamber 3 and the second fuel chamber 4 with fuel from the fuel tank 34. When the engine-driven device is at rest, that is, when the engine is not running, the normally open valve 7 between the first fuel chamber 3 and the second fuel chamber 4 is open and the normally closed valve 8 between the second fuel chamber 8 and the engine's intake tract 32 is closed. Accordingly, operation of the purge device pumps fuel into the first fuel chamber 3 from the fuel tank 34 and from the first fuel chamber 3 into the second fuel chamber 4, through the normally open valve 7. Fuel remains in the second fuel chamber 4 due to the closed normally closed valve 8.

In addition to filling the first and second fuel chambers 3, 4 of the enrichment device with fuel, operation of the purge device 31 purges air and fuel from the various passageways and chambers within the carburetor 33. When the first and second fuel chambers 3, 4 are full of fuel, operation of the purge device 31 causes fuel to circulate from the fuel tank 34, through the first fuel chamber 3 and through the carburetor, returning to the fuel tank 34. Operation of the purge device 31 does not cause fuel to discharge into the carburetor's air passage having a venturi or into the engine's intake tract 32. Therefore, it is to be appreciated that operation of the purge device 31 does not provide a fuel enrichment effect, but merely purges the fuel delivery system as described above. Furthermore, operation of the purge device 31 will not cause the engine to flood, because no fuel enrichment takes place. Operation of the purge device 31 may be desirable after long periods of engine rest, which can result in the evaporation of fuel from the fuel enrichment device 1 and carburetor 33.

Prior to starting the engine, an operator would move an ignition switch to the ON position and operate the purge device 31, thereby purging the fuel delivery system as described above. The operator would then pull a starter rope or engage a starting motor. Pulling a starter rope or engaging a starting motor causes a flywheel to turn, which results in the generation of electricity via an ignition module. The generation of electricity energizes the solenoid 13 on the fuel enrichment device 1. When the solenoid 13 is energized, it actuates both valves 7, 8 via the beam 11. The normally open valve 7 is moved to its closed position and the normally closed valve 8 is moved to its open position. With the normally open valve 7 now closed, fuel cannot flow into the second fuel chamber 4. Fuel flows out of the second fuel chamber 4 directly to the engine's intake tract 32.

The fuel from the second fuel chamber 4 that enters the engine's intake tract 32 provides enrichment during engine starting and warm-up. The fuel from the second fuel chamber 4 supplements the fuel/air mixture from the carburetor 33 with a predetermined amount of enriching fuel based on the volume of the second fuel chamber 4. Because the air/fuel mixture in the engine's intake tract is enriched by fuel from the second fuel chamber 4, no air choke is needed on the carburetor 33.

The normally open valve 7 remains closed so long as the engine is running and the solenoid 13 is powered. With the normally open valve 7 closed, fuel cannot flow into the second fuel chamber 4. As discussed above, operation of the purge device 31 does not provide a fuel enrichment effect. Because only a predetermined amount of fuel from the second fuel chamber 4 flows into the intake tract 32 and operation of the purge device does not provide fuel enrichment, the engine will not flood.

When the engine is running, fuel flows from the fuel tank 34 to the first fuel chamber 3. The carburetor 33 draws fuel from the first fuel chamber 3. The first fuel chamber 3 acts as a fuel holding chamber during operation of the engine. After discharging enriching fuel to the engine's intake tract 32, the second fuel chamber 4 remains empty until the engine is stopped.

At the moment when the engine is stopped, the first fuel chamber 3 is full of fuel, while the second fuel chamber 4 is empty. Upon stopping the engine, the solenoid 13 is denergized, which causes the normally open valve 7 between the first fuel chamber 3 and the second fuel chamber 4 to return to the open position and the normally closed valve 8 to return to the closed position. Fuel located in the first fuel chamber 3 when the engine was stopped drains into the second fuel chamber 4 through the open normally open valve 7. In an embodiment, vapor pressure from the carburetor 33 helps force fuel from the first fuel chamber 3 into the second fuel chamber 4. The fuel remains in the second fuel chamber 8 and does not drain into the engine's intake tract 32, because the normally closed valve 8 is closed. When the engine is restarted, the normally closed valve 8 is opened by the energized solenoid 13, and enriching fuel drains out of the second fuel chamber 4 and into the engine's intake tract 32 as described above. Prior to restarting the engine, the purge device 31 can be operated to fill the first fuel chamber 3 with fuel without risk of flooding the engine.

In an embodiment, the second fuel chamber 4 provides enriching fuel to the carburetor 33 instead of or in addition to providing enriching fuel to directly to the intake tract 32.

In an embodiment, the engine includes a carburetor adapter in fluid communication with both of the second fuel chamber 4 and carburetor 33 air passage. The carburetor 33 air passage provides an air/fuel mixture to the carburetor adapter. The second fuel chamber 4 provides enriching fuel to the carburetor adapter.

In an embodiment, a check valve is located between the fuel tank 34 and the first fuel chamber 3 of the enrichment device for the reduction of hot-starting.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A fuel enrichment device, comprising:

a body forming a first fuel chamber and a second fuel chamber, wherein the second fuel chamber is adapted to contain a predetermined amount of enriching fuel to be provided to an engine;

a normally open valve connecting the first fuel chamber to the second fuel chamber; and a normally closed valve for controlling the provision of enriching fuel to the engine, wherein the normally closed valve is open whenever the normally open valve is closed.

2. A fuel enrichment device comprising:

a body forming a first fuel chamber and a second fuel chamber, wherein the second fuel chamber is adapted to contain a predetermined amount of enriching fuel to be provided to an engine;

a normally open valve connecting the first fuel chamber to the second fuel chamber;

a normally closed valve for controlling the provision of enriching fuel to the engine, wherein the normally closed valve is open whenever the normally open valve is closed; and a solenoid for controlling an operation of at least one of the normally open valve and the normally closed valve.

3. A fuel enrichment device as set forth in claim 2, wherein the solenoid is energized when the engine is started.

4. A fuel enrichment device comprising:

a body forming a first fuel chamber and a second fuel chamber, wherein the second fuel chamber is adapted to contain a predetermined amount of enriching fuel to be provided to an engine;

a normally open valve connecting the first fuel chamber to the second fuel chamber;

a normally closed valve for controlling the provision of enriching fuel to the engine, wherein the normally closed valve is open whenever the normally open valve is closed; and a purge device, wherein an operation of the purge device while the engine is not running fills the first fuel chamber with fuel.

5. A fuel enrichment device as set forth in claim 4, wherein the fuel enrichment device is in fluid communication with a carburetor, and further wherein said operation of the purge device fills the second fuel chamber with fuel and purges fuel from the carburetor.

6. A fuel enrichment device as set forth in claim 1, wherein the fuel enrichment device is in fluid communication with a carburetor, and further wherein the carburetor draws fuel from the fuel enrichment device until the engine is stopped.

7. A fuel enrichment device as set forth in claim 6, wherein the carburetor lacks an air choke.

8. A fuel enrichment device as set forth in claim 6, wherein the enriching fuel from the second fuel chamber is provided directly to an intake of the engine and not provided to the carburetor.

9. An engine priming system, comprising:

an engine having an intake for receiving a fuel and air mixture;

a carburetor having an air passage for mixing fuel and air, wherein the air passage is in fluid communication with the intake; and an automatic fuel enrichment device comprising a body forming a first fuel chamber in fluid communication with the carburetor and a second fuel chamber in fluid communication with both of the intake and the first fuel chamber, wherein the automatic fuel enrichment device automatically provides a predetermined amount of enriching fuel directly to the intake.

10. An engine priming system comprising:

an engine having an intake for receiving a fuel and air mixture;

a carburetor having an air passage for mixing fuel and air, wherein the air passage is in fluid communication with the intake;

an automatic fuel enrichment device comprising a body forming a first fuel chamber in fluid communication with the carburetor and a second fuel chamber in fluid communication with both of the intake and the first fuel chamber, wherein the automatic fuel enrichment device automatically provides a predetermined amount of enriching fuel directly to the intake;

a normally open valve connecting the first fuel chamber to the second fuel chamber; and a normally closed valve connecting the second fuel chamber to the intake for controlling the provision of the enriching fuel to the intake, wherein operation of the normally open valve is interlocked with operation of the normally closed valve so that the normally closed valve is open whenever the normally open valve is closed.

11. An engine priming system as set forth in claim 10, wherein the normally open valve is closed if the engine is running.

12. An engine priming system comprising:

an engine having an intake for receiving a fuel and air mixture;

a carburetor having an air passage for mixing fuel and air, wherein the air passage is in fluid communication with the intake;

an automatic fuel enrichment device comprising a body forming a first fuel chamber in fluid communication with the carburetor and a second fuel chamber in fluid communication with both of the intake and the first fuel chamber, wherein the automatic fuel enrichment device automatically provides a predetermined amount of enriching fuel directly to the intake; and a purge device, wherein an operation of the purge device while the engine is not running fills the first fuel chamber with fuel and purges fuel from the carburetor.

13. An engine priming system as set forth in claim 12, wherein no fuel is discharged into the air passage due to said operation of the purge device.

14. An engine priming system as set forth in claim 9, wherein the carburetor lacks an air choke.

15. A fuel enrichment device, comprising:

a body forming a first fuel chamber and a second fuel chamber, wherein the second fuel chamber is adapted to contain a predetermined amount of enriching fuel to be provided to an engine;

a valve connecting the first fuel chamber to the second fuel chamber that is closed if the engine is running and open if the engine is not running; and an additional valve for controlling the provision of enriching fuel to the engine, wherein the additional valve is open if the engine is running and closed if the engine is not running.

16. A fuel enrichment device as set forth in claim 15, further comprising a solenoid for controlling an operation of at least one of the valve and the additional valve.

17. A fuel enrichment device as set forth in claim 16, wherein the solenoid is energized when the engine is started.

18. A fuel enrichment device as set forth in claim 15, further comprising a purge device, wherein an operation of the purge device while the engine is not funning fills the first fuel chamber with fuel.

19. A fuel enrichment device as set forth in claim 18, wherein the fuel enrichment device is in fluid communication with a carburetor, and further wherein said operation of the purge device fills the second fuel chamber with fuel and purges fuel from the carburetor.

20. A fuel enrichment device as set forth in claim 15, wherein the fuel enrichment device is in fluid communication with a carburetor, and further wherein the carburetor draws fuel from the fuel enrichment device until the engine is stopped.

21. A fuel enrichment device as set forth in claim 20, wherein the carburetor lacks an air choke.

22. A fuel enrichment device as set forth in claim 20, wherein the enriching fuel from the second fuel chamber is provided directly to an intake of the engine and not provided to the carburetor.

* * * * *